US008025511B2

(12) United States Patent
Aihara et al.

(10) Patent No.: US 8,025,511 B2
(45) Date of Patent: Sep. 27, 2011

(54) CONNECTOR

(75) Inventors: Shuichi Aihara, Tokyo (JP); Takayoshi Yamauchi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 12/905,128

(22) Filed: Oct. 15, 2010

(65) Prior Publication Data

US 2011/0097932 A1 Apr. 28, 2011

(30) Foreign Application Priority Data

Oct. 28, 2009 (JP) ..... 2009-247423

(51) Int. Cl.
*H01R 13/44* (2006.01)

(52) U.S. Cl. ..... 439/141

(58) Field of Classification Search ..... 439/141, 439/140

See application file for complete search history.

(56) References Cited

U.S. PATENT DOCUMENTS 5,277,603 A * 1/1994 Yamatani et al. ..... 439/140
7,104,814 B1 * 9/2006 She et al. ..... 439/131
7,300,292 B2 * 11/2007 Nagata ..... 439/141
7,695,294 B2 * 4/2010 Lu ..... 439/141
2003/0013333 A1 * 1/2003 Nagata ..... 439/141

FOREIGN PATENT DOCUMENTS

JP 2000-171724 A 6/2000

* cited by examiner

*Primary Examiner* — Gary F. Paumen

(74) *Attorney, Agent, or Firm* — Holtz, Holtz, Goodman & Chick, PC

(57) ABSTRACT

A connector is matable with a mating connector. The connector has a contact, a housing, a sliding shell, at least one engagement portion and at least one disengagement portion. The housing holds the contact. The sliding shell covers, at least in part, the contact and the housing. The sliding shell is held on the housing so as to be movable between a mating position and a protective position. The connector is mated with the mating connector when the sliding shell is positioned at the mating position. The sliding shell is laid, at least in part, beyond a front end of the housing when the sliding shell is positioned at the protective position. The at least one engagement portion is configured to engage with the sliding shell located at the protective position so as to prevent the sliding shell from moving toward the mating position. The at least one disengagement portion is configured to disengage the engagement portion from the sliding shell when the at least one disengagement portion is brought into contact with the mating connector upon a mating process between the connector and the mating connector.

13 Claims, 8 Drawing Sheets

CONNECTOR

CROSS REFERENCE TO RELATED APPLICATIONS

Applicants claim priority under 35 U.S.C. §119 of Japanese Patent Application No. JP2009-247423 filed Oct. 28, 2009.

BACKGROUND OF THE INVENTION

The present invention relates to a connector having a mechanism operable to protect a contact in a state where the connector is not mated with a mating connector.

This type of connector is disclosed in JP-A2000-171724. A connector disclosed in JP-A2000-171724 includes a connector body connectable to a mating connector and a protective cover for covering contacts of the connector body when the connector body is not connected to the mating connector.

In the connector disclosed in JP-A2000-171724, the contacts of the connector body are protected by the protective cover separate from the connector body that forms a connection interface for the mating connector. Therefore, the number of parts is increased, and the size of the connector is increased.

Furthermore, in the connector disclosed in JP-A2000-171724, if a force is applied rearward to a front end of the protective cover when the connector body is not connected to the mating connector, the protective cover might move rearward. As a result, the contacts might unintentionally be exposed.

SUMMARY OF THE INVENTION

It is therefore an object of the present invention to solve the above-mentioned problem and to provide a connector having a contact protection mechanism which has a new structure different from that of JP-A2000-171724.

One aspect of the present invention provides a connector matable with a mating connector. The connector has a contact, a housing, a sliding shell, at least one engagement portion and at least one disengagement portion. The housing holds the contact. The sliding shell covers, at least in part, the contact and the housing. The sliding shell is held on the housing so as to be movable between a mating position and a protective position. The connector is mated with the mating connector when the sliding shell is positioned at the mating position. The sliding shell being laid, at least in part, beyond a front end of the housing when the sliding shell is positioned at the protective position. The at least one engagement portion is configured to engage with the sliding shell located at the protective position so as to prevent the sliding shell from moving toward the mating position. The at least one disengagement portion is configured to disengage the engagement portion from the sliding shell when the at least one disengagement portion is brought into contact with the mating connector upon a mating process between the connector and the mating connector.

An appreciation of the objectives of the present invention and a more complete understanding of its structure may be had by studying the following description of the preferred embodiment and by referring to the accompanying drawings.

Figure 1:
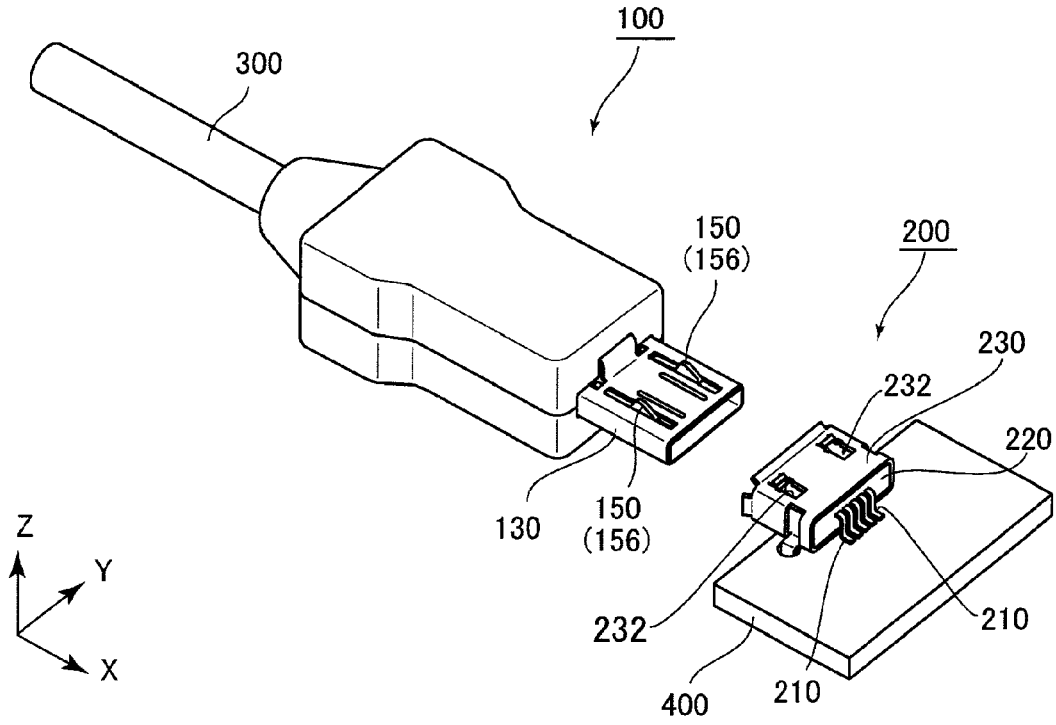
FIG. 1 is a perspective view showing a connector (plug connector) and a mating connector (receptacle connector) according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Referring to FIG. 1, a connector 100 according to an embodiment of the present invention is a standardized plug connector such as a USB-3.0 connector. The connector 100 is matable with a mating connector 200 of receptacle type. The connector 100 is connected to a cable 300. The mating connector 200 is mounted on a circuit board 400. The mating connector 200 includes a plurality of mating contacts 210 made of a conductive material, a mating housing 220 made of an insulating material, and a mating shell 230 made of a conductive material. The mating housing 220 holds the mating contacts 210. The mating shell 230 covers the mating housing 220. The mating shell 230 has two lock holes 232 formed in an upper portion thereof.

As shown in FIGS. 1 to 4, the connector 100 includes a plurality of contacts 110 made of a conductive material, a housing 120 made of an insulating material, a sliding shell 130 made of a conductive material, shell stoppers 140 made of a conductive material, lock members 150 made of a conductive material, and springs (biasing members) 160 made of a conductive material. The housing 120 holds the contacts 110. The sliding shell 130 is supported on the housing 120 so as to be movable (slidable) along the positive or negative X-direction (longitudinal direction or mating/separating direction). The shell stoppers 140 serve to position the sliding shell 130. The lock members 150 serve to lock a mating state of the mating shell 230 with the sliding shell 130.

Figure 4:
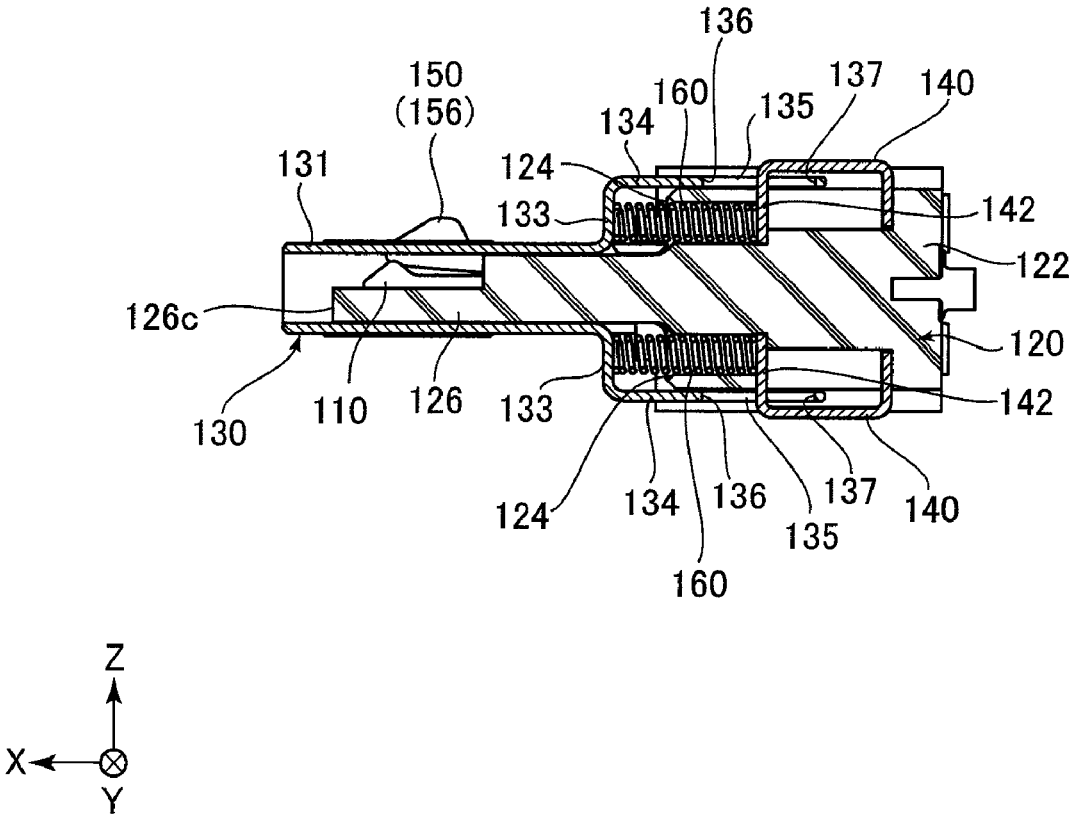
FIG. 4 is another cross-sectional view showing the structure for protecting the contacts in the connector of FIG. 2.

Particularly, as shown in FIG. 4, the housing 120 includes a block portion 122 and a plate portion 126 extending frontward from the block portion 122 along the X-direction. The block portion 122 has receiver holes 124 near the center thereof in the Y-direction. The receiver holes 124 extend rearward toward the negative X-direction. In the present embodiment, the block portion 122 has the two receiver holes 124 formed in an upper portion and a lower portion thereof, respectively. Each of the receiver holes 124 receives at least part of the spring 160.

Figure 2:
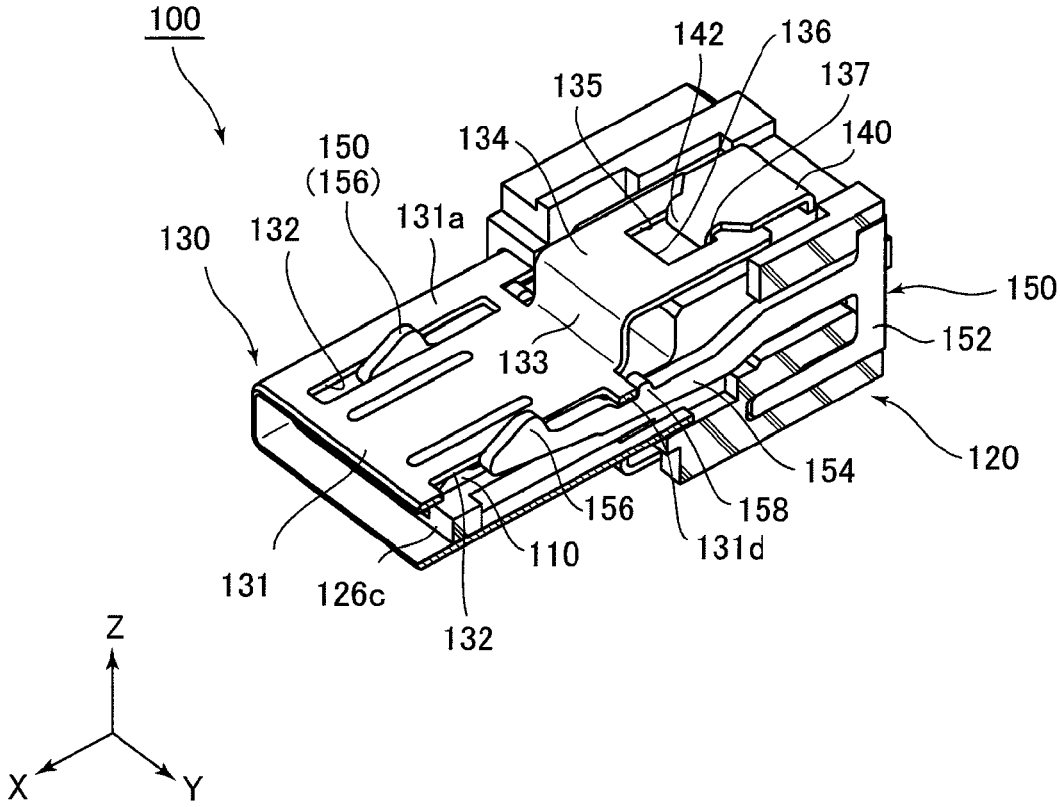
FIG. 2 is a perspective view showing a structure for protecting contacts along with a partial cross-section in the connector of FIG. 1.
Figure 3:
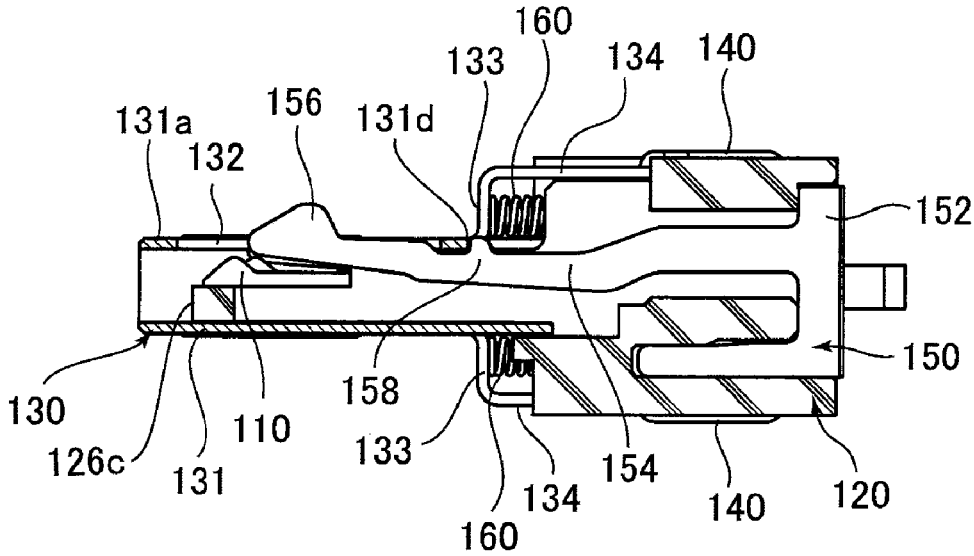
FIG. 3 is a cross-sectional view showing the structure for protecting the contacts in the connector of FIG. 2.
Figure 3:
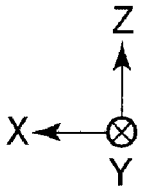

As shown in FIGS. 2 to 4, the sliding shell 130 includes a mating portion 131, pressed portions 133 and rear extensions 134. The sliding shell 130 covers, at least in part, the contacts 110 and the housing 120. The mating portion 131 is matable with the mating shell 230. The mating portion 131 has a rear end 131*d*. The pressed portions 133 extend from the vicinity of the rear end 131*d* toward the positive Z-direction (upward direction) and the negative Z-direction (downward direction), respectively. The rear extensions 134 extend rearward from the pressed portions 133 toward the negative X-direction, respectively. The mating portion 131 primarily covers the plate portion 126 of the housing 120 and is slidable on an upper surface and a lower surface of the plate portion 126. The mating portion 131 includes an upper portion 131*a* having two receptacle slits 132 extending along the X-direction. Ends of the springs 160 are brought into contact with rear surfaces of the pressed portions 133. Thus, the pressed portions 133 are pressed (therefore, the entire sliding shell 130 is pressed) toward the positive X-direction (frontward) by the springs 160. The rear extensions 134 are slidable on an upper surface and a lower surface of the block portion 122, respectively. Each of the rear extensions 134 has an opening portion 135 formed therein. In the present embodiment, a distance between a front edge 136 and a rear edge 137 of the opening portion 135 in the X-direction determines a movable distance (slidable distance) of the sliding shell 130 in the X-direction, as described later.

As shown in FIGS. 2 and 4, the connector 100 of this embodiment has two shell stoppers 140. The shell stoppers 140 are held on the upper surface and the lower surface of the block portion 122 of the housing 120, respectively. Each of the shell stoppers 140 roughly has a hook-shaped cross-section on the XZ-plane. Each of the shell stoppers 140 has a receiver portion 142 provided on a front end thereof. Each of the receiver portions 142 is inserted in the opening portion 135 formed in the corresponding rear extension 134 and held on the block portion 122.

The sliding shell 130 receives a force applied toward the positive X-direction from the springs 160. When the sliding shell 130 is moved toward the positive X-direction, the receiver portions 142 are brought into contact with the rear edges 137 of the opening portions 135. Therefore, the sliding shell 130 cannot move beyond (frontward from) a position at which the sliding shell 130 is located when the receiver portions 142 receive the rear edges 137 of the opening portions 135. Specifically, in the present embodiment, the maximum reachable position in the X-direction of the sliding shell 130 is defined by the contact of the rear edges 137 of the opening portions 135 and the receiver portions 142. Thus, the rear edges 137 of the opening portions 135 and the receiver portions 142 serve as a reachable range defining portion for defining the maximum reachable position of the sliding shell 130.

More specifically, the sliding shell 130 is located beyond a front end 126*c* of the plate portion 126 of the housing 120 toward the positive X-direction. Thus, the sliding shell 130 properly protects the contacts 110 from the outside of the contacts 110. The position of the sliding shell 130 at that time is referred to as "protective position". As can be seen from the configuration described above, the springs 160 bias the sliding shell 130 toward the protective position. Nothing, except the contact of the rear edges 137 of the opening portions 135 and the receiver portions 142, resists the bias of the springs 160 when the connector 100 is not connected to nor mated with the mating connector 200. Therefore, the sliding shell 130 is moved to the protective position when the connector 100 is not connected to nor mated with the mating connector 200.

When the connector 100 is mated with the mating connector 200, the sliding shell 130 of this embodiment is located at a position where the front edges 136 of the opening portions 135 are brought into contact with the receiver portions 142. The position of the sliding shell 130 at that time is referred to as "mating position". If the sliding shell 130 is pressed toward the negative X-direction, the receiver portions 142 of the shell stoppers 140 receive the front edges 136 of the opening portions 135. Therefore, the sliding shell 130 cannot move beyond the mating position toward the negative X-direction.

Specifically, the sliding shell 130 according to the present embodiment is held on the housing 120 so as to be movable between the protective position and the mating position along the X-direction. As can be seen from the above discussion, the protective position and the mating position are determined by the positional relationship of the receiver portions 142 with the rear edges 137 and the front edges 136 of the opening portions 135, respectively. The distance between the protective position and the mating position is determined by the distance between the rear edges 137 and the front edges 136. Accordingly, for example, once the mating position is determined by adjusting the positional relationship of the front edges 136 with the receiver portions 142, the size of the opening portions 135 (particularly, a distance between the rear edges 137 and the front edges 136) can be determined depending upon the desired maximum reachable position. In the present embodiment, when the sliding shell 130 is located at the mating position, the front end of the sliding shell 130 is located at substantially the same position as the front end 126*c* of the plate portion 126 of the housing 120 in the X-direction. Furthermore, the shell stoppers 140 of this embodiment are electrically connected to a ground line of the cable 300 by some means, which are not illustrated in the drawings. Therefore, in the present embodiment, the sliding shell 130 is electrically connected to the ground line of the cable 300 via the shell stoppers 140 when the sliding shell 130 is located at the mating position.

Particularly, each of the receiver portions 142 of this embodiment reaches within the corresponding receiver hole 124. The rear ends of the springs 160 are pressed against the receiver portions 142 within the receiver holes 124. Specifically, the springs 160 are sandwiched between the receiver portions 142 of the shell stoppers 140 and the pressed portions 133 of the sliding shell 130. Thus, the springs 160 electrically connect the receiver portions 142 of the shell stoppers 140 to the pressed portions 133 of the sliding shell 130. However, the springs 160 may function as inductances and they may exert considerable influence especially in a high frequency region. Therefore, in the present embodiment, the sliding shell 130 at the mating position is brought into direct contact with the shell stoppers 140 in order to ensure an electrical path of low inductance and enhance grounding.

As shown in FIGS. 2 and 3, the connector 100 of this embodiment has two lock members 150. The lock members 150 are configured to engage with the lock holes 232 of the mating shell 230, respectively, so as to lock a mating state of the connector 100 with the mating connector 200. Each of the lock members 150 has a fixed portion 152, an arm 154, a lock protrusion 156 and an engagement portion 158. The fixed portion 152 is fixed to the block portion 122 of the housing 120. The arm 154 extends from the fixed portion 152 toward the positive X-direction. The lock protrusion 156 is provided on an end of the arm 154. The engagement portion 158 is formed in the middle of the arm 154. In other words, the engagement portion 158 is positioned between the lock protrusion 156 and the fixed portion 152. Both of the lock protrusion 156 and the engagement portion 158 project toward the positive Z-direction from the arm 154. When the sliding shell 130 is located at the protective position, the lock protrusion 156 projects upward from the mating portion 131 through the receptacle slit 132 formed in the upper portion 131*a* of the mating portion 131 of the sliding shell 130. The arm 154 of this embodiment is resiliently deformable. Because of the resilience of the arm 154, the lock protrusion 156 is moved downward from its original position when a downward pressure is applied to the lock protrusion 156, and the lock protrusion 156 is returned to the original position when the pressure is released. Furthermore, since the lock protrusion 156 and the engagement portion 158 are elastically supported on the common arm 154, the engagement portion 158 is moved downward during the downward movement of the lock protrusion 156.

The engagement portions 158 of this embodiment are located behind the rear end 131*d* of the mating portion 131 when the sliding shell 130 is located at the protective position. Therefore, even when the sliding shell 130 is pushed toward the negative X-direction, the engagement portions 158 engage with the rear end 131*d* of the mating portion 131 so that the sliding shell 130 is prevented from moving toward the negative X-direction. When the lock protrusions 156 are pressed downward, the engagement portions 158 are moved downward as described above and are thus disengaged from the rear end 131*d* of the mating portion 131 of the sliding shell 130. When the engagement portions 158 are disengaged, the sliding shell 130 can be moved toward the negative X-direction. As can be seen from this configuration, the lock protrusions 156 serve as a disengagement portion configured to disengage the engagement portions 158 from the rear end 131*d* of the mating portion 131 of the sliding shell 130.

In the present embodiment, each of the two lock members 150 includes the engagement portion 158. Therefore, a protective state of the contacts 110 where the sliding shell 130 is prevented from moving toward the negative X-direction is maintained unless both of the engagement portions 158 are disengaged from the sliding shell 130. In other words, the sliding shell 130 is prevented from moving toward the mating position when at least one of the engagement portions 158 engages with the sliding shell 130. Particularly, in the present embodiment, the two lock protrusions 156 are located at the same position in the X-direction. Accordingly, those lock protrusions 156 are simultaneously pressed down only when the sliding shell 130 is correctly mated with the mating shell 230 except in a case where the two lock protrusions 156 are intentionally pushed down. For example, if the sliding shell 130 is inserted obliquely into the mating shell 230, the two lock protrusions 156 are not pressed down simultaneously. Therefore, the two engagement portions 158 are not simultaneously disengaged from the sliding shell 130. Thus, by properly arranging a plurality of pairs of the engagement portion 158 and the disengagement portion (lock protrusion 156) in consideration of a mating state of the sliding shell 130 with the mating shell 230, the sliding shell 130 can be made slidable only when the sliding shell 130 is correctly mated with the mating shell 230.

Connection operation of the connector 100 and the mating connector 200 will be described with further reference to FIGS. 5 to 8.

Figure 5:
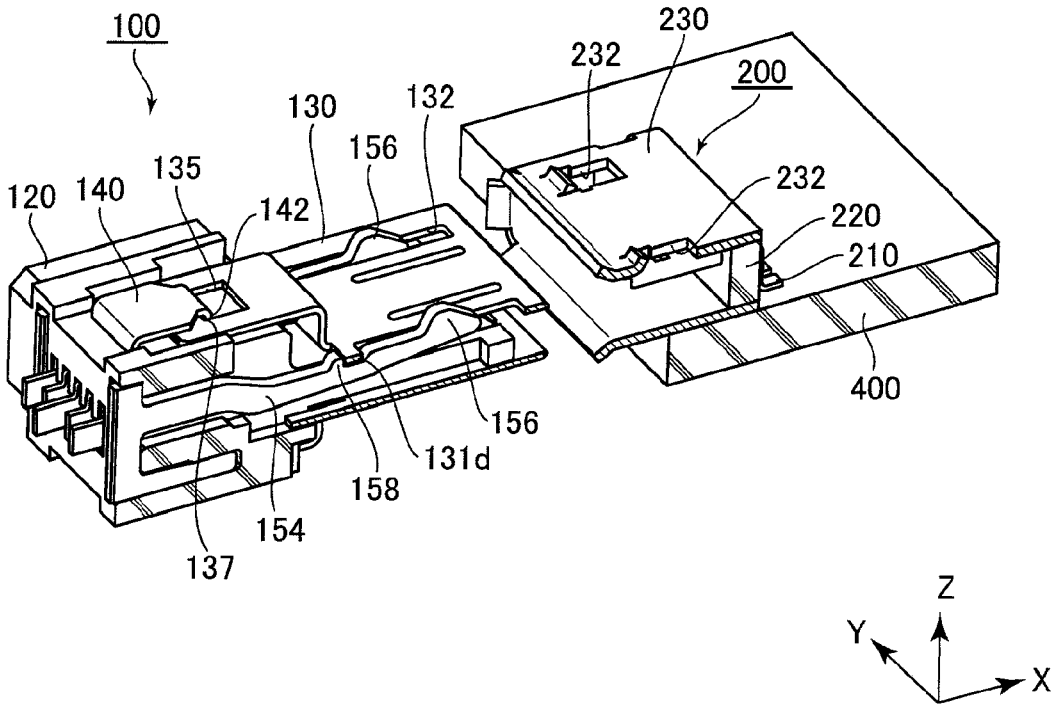
FIG. 5 is a perspective view showing a mating process of the plug connector and the receptacle connector of FIG. 1 along with a partial cross-section.

When the sliding shell 130 is located at the protective position as shown in FIG. 5, the engagement portions 158 are located behind the rear end 131*d* of the mating portion 131 of the sliding shell 130. Therefore, even if a force is applied to the sliding shell 130 toward the negative X-direction, the engagement portions 158 engage with the rear end 131*d* of the sliding shell 130 so that the sliding shell 130 cannot move from the protective position toward the mating position. In other words, the protective state of the contacts 110 by the sliding shell 130 is maintained.

Figure 6:
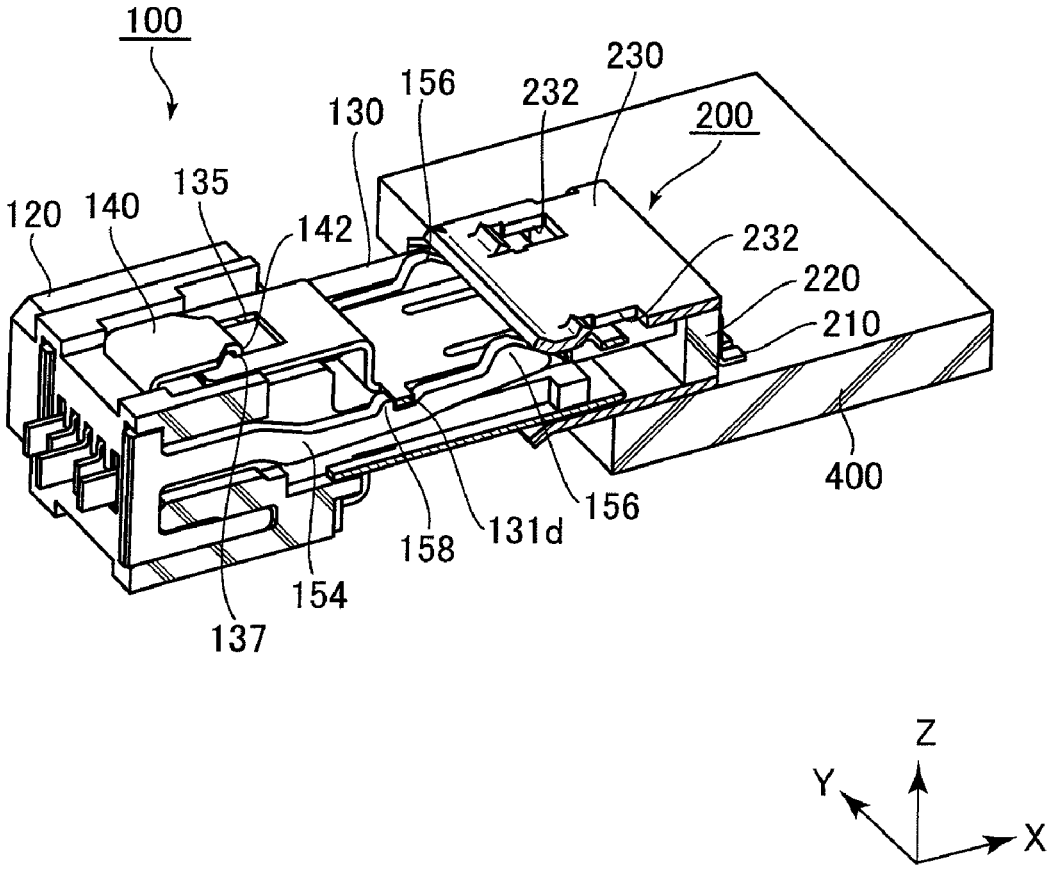
FIG. 6 is a perspective view showing a mating process subsequent to FIG. 5 along with a partial cross-section.

During a subsequent mating process of the connector 100 with the mating connector 200, the two lock protrusions 156 are simultaneously brought into contact with the mating shell 230 as shown in FIG. 6. At that time, the engagement portions 158 remain engaged with the rear end 131*d* of the sliding shell 130. Accordingly, the sliding shell 130 is still prevented from moving toward the mating position.

Figure 7:
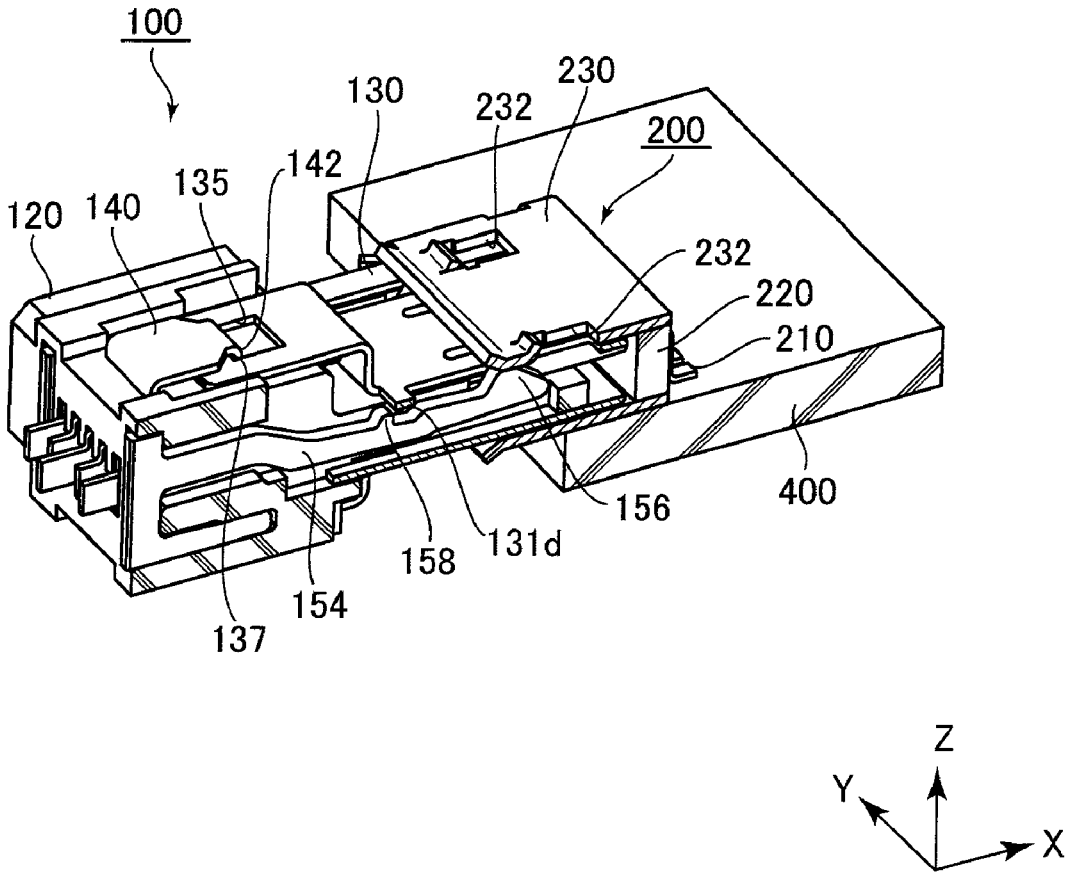
FIG. 7 is a perspective view showing a mating process subsequent to FIG. 6 along with a partial cross-section.

When the mating process further proceeds in a proper manner, the two lock protrusions 156 are pressed down by the mating shell 230 as shown in FIG. 7. At that time, the engagement portions 158 are disengaged from the rear end 131*d*. Therefore, the sliding shell 130 can move toward the negative X-direction.

Figure 8:
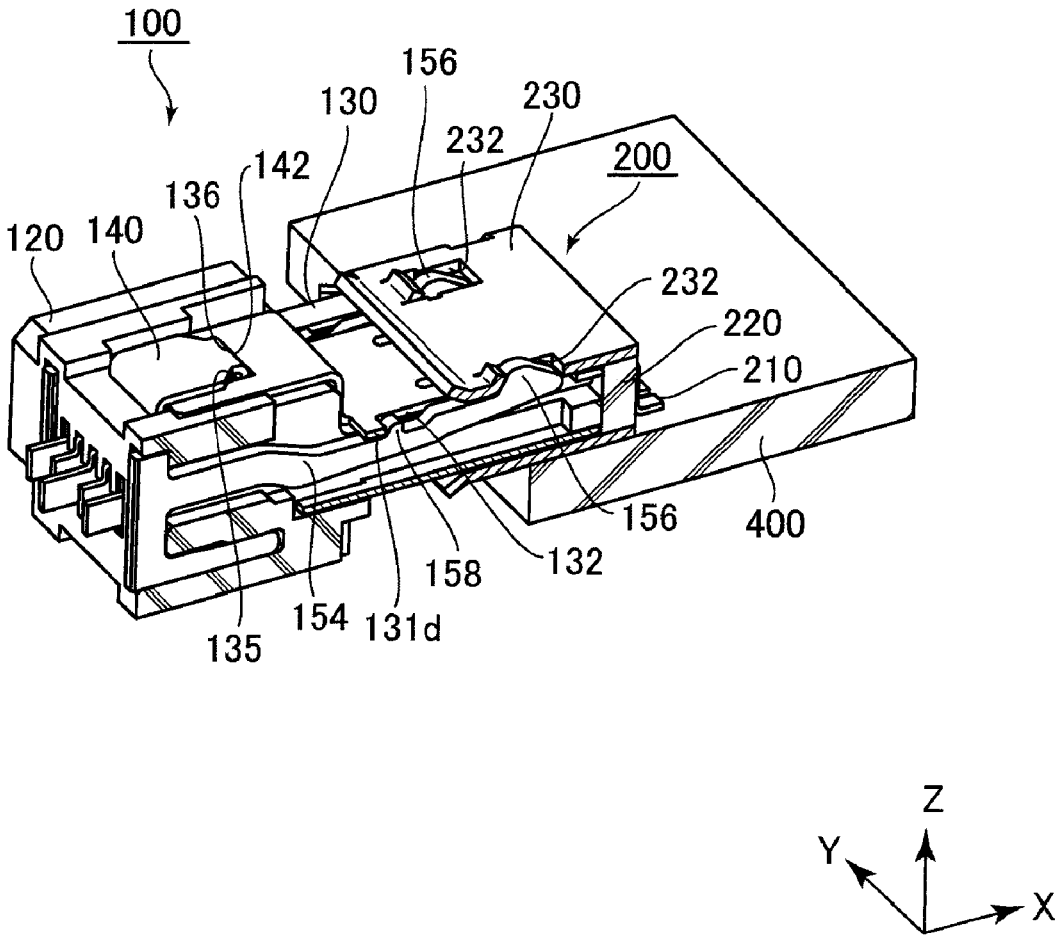
FIG. 8 is a perspective view showing a mating process subsequent to FIG. 7 along with a partial cross-section.

When the connector 100 is further pressed into the mating connector 200, a friction between the mating shell 230 and the sliding shell 130 moves the sliding shell 130 toward the negative X-direction until the receiver portions 142 of the shell stoppers 140 receive the front edges 136 of the opening portions 135 of the sliding shell 130. At that time, the sliding shell 130 is positioned at the mating position as shown in FIG. 8. When the sliding shell 130 is positioned at the mating position, the lock protrusions 156 return back to the inside of the lock holes 232 due to elastic forces of the arms 154. At that time, the engagement portions 158 are also located within the receptacle slits 132. Therefore, the engagement portions 158 do not prevent engagement of the lock protrusions 156 with the lock holes 232.

While the specific embodiment of the present invention has been described above, the present invention is not limited to the illustrated embodiment.

For example, the illustrated spring 160 is formed of a coiled spring. Instead of the coiled spring, a flat spring may be used. The flat spring may be formed integrally with the sliding shell 130. Specifically, for example, portions extending in the Y-direction may be added to the pressed portions 133 and folded back rearward so as to form flat springs. Those portions may be brought into contact with the front end of the block portion 122 of the housing 120.

Furthermore, in the above embodiment, the engagement portion 158 and the lock protrusion (disengagement portion) 156 are provided on a common lock member 150. However, the engagement portion 158 and the lock protrusion 156 may be provided on separated members. However, it is possible to prevent an increase of the number of parts and to prevent an increase of the size of parts if the engagement portion 158 and the lock protrusion (disengagement portion) 156 are provided on the common member as in the above embodiment. Particularly, because the lock members 150 of the above embodiment are required by the standard, it is possible to suppress an increase of the number of parts by using those lock members 150.

Although the connector of the above embodiment is standardized, the present invention is not limited to a standardized connector. Specifically, the present invention is not limited to specific standards.

Additionally, an electric connector for establishing an electric connection has been described as an example of the above embodiment. However, the present invention is not limited to an electric connector. For example, the present invention is applicable to an optical-electrical composite connector for establishing connection of an optical fiber in addition to electric connection of a conductive contact.

The present application is based on a Japanese patent application of JP2009-247423 filed before the Japan Patent Office on Oct. 28, 2009, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector matable with a mating connector, the connector comprising:

a contact;

a housing holding the contact;

a sliding shell covering, at least in part, the contact and the housing, the sliding shell being held on the housing so as to be movable between a mating position and a protective position, the connector being mated with the mating connector when the sliding shell is positioned at the mating position, the sliding shell being laid, at least in part, beyond a front end of the housing when the sliding shell is positioned at the protective position;

at least one engagement portion configured to engage with the sliding shell located at the protective position so as to prevent the sliding shell from moving toward the mating position; and at least one disengagement portion configured to disengage the engagement portion from the sliding shell when the at least one disengagement portion is brought into contact with the mating connector upon a mating process between the connector and the mating connector.

2. The connector as recited in claim 1, further comprising a biasing member which biases the sliding shell toward the protective position.

3. The connector as recited in claim 1, comprising a plurality of pairs of the engagement portion and the disengagement portion, wherein the sliding shell is prevented from moving toward the mating position when at least one of the engagement portions engages with the sliding shell.

4. The connector as recited in claim 1, wherein the engagement portion and the disengagement portion are provided on a common member.

5. The connector as recited in claim 1, further comprising a reachable range defining portion for defining a maximum reachable position of the sliding shell, the sliding shell being not allowed to move frontward beyond the maximum reachable position.

6. The connector as recited in claim 1, further comprising a shell stopper arranged to receive the sliding shell so that the sliding shell is not allowed to move rearward beyond the mating position.

7. The connector as recited in claim 1, further comprising:

a reachable range defining portion for defining a maximum reachable position of the sliding shell, the sliding shell being not allowed to move frontward beyond the maximum reachable position; and a shell stopper arranged to receive the sliding shell so that the sliding shell is not allowed to move rearward beyond the mating position.

8. The connector as recited in claim 1, further comprising a shell stopper arranged to receive the sliding shell so that the sliding shell is not allowed to move rearward beyond the mating position, the shell stopper being arranged to be grounded so that the sliding shell is grounded through the shell stopper when the sliding shell is located at the mating position.

9. The connector as recited in claim 1, further comprising:

a reachable range defining portion for defining a maximum reachable position of the sliding shell, the sliding shell being not allowed to move frontward beyond the maximum reachable position; and a shell stopper arranged to receive the sliding shell so that the sliding shell is not allowed to move rearward beyond the mating position, the shell stopper being arranged to be grounded so that the sliding shell is grounded through the shell stopper when the sliding shell is located at the mating position.

10. The connector as recited in claim 1, further comprising a shell stopper, wherein:

the sliding shell has an opening portion with a front edge and a rear edge;

the shell stopper has a receiver portion located within the opening portion;

when the receiver portion receives the front edge of the opening portion, the sliding shell is not allowed to move rearward beyond the mating position;

the receiver portion and the rear edge of the opening portion serve as a reachable range defining portion which defines a maximum reachable position of the sliding shell as a position at which the sliding shell is located when the receiver portion receives the rear edge of the opening portion; and the sliding shell is not allowed to move frontward beyond the maximum reachable position.

11. The connector as recited in claim 1, wherein the sliding shell has an opening portion with a front edge and a rear edge.

12. The connector as recited in claim 11, further comprising a shell stopper arranged to receive the sliding shell so that the sliding shell is not allowed to move rearward beyond the mating position.

13. The connector as recited in claim 12, wherein:

the shell stopper has a receiver portion located within the opening portion;

when the receiver portion receives the front edge of the opening portion, the sliding shell is not allowed to move rearward beyond the mating position;

the receiver portion and the rear edge of the opening portion serve as a reachable range defining portion which defines a maximum reachable position of the sliding shell as a position at which the sliding shell is located when the receiver portion receives the rear edge of the opening portion; and the sliding shell is not allowed to move frontward beyond the maximum reachable position.

* * * * *